US009310146B2

(12) United States Patent
Gibbens et al.

(10) Patent No.: US 9,310,146 B2
(45) Date of Patent: Apr. 12, 2016

(54) UPPER RECEIVER ASSEMBLY FOR A WEAPON

(71) Applicants: Kevin W. Gibbens, Mesa, AZ (US); David W. Gibbens, Mesa, AZ (US)

(72) Inventors: Kevin W. Gibbens, Mesa, AZ (US); David W. Gibbens, Mesa, AZ (US)

( * ) Notice: Subject to any disclaimer, the term of this patent is extended or adjusted under 35 U.S.C. 154(b) by 0 days.

(21) Appl. No.: 14/257,885

(22) Filed: Apr. 21, 2014

(65) Prior Publication Data

US 2015/0226501 A1 Aug. 13, 2015

Related U.S. Application Data

(60) Provisional application No. 61/814,220, filed on Apr. 20, 2013.

(51) Int. Cl.

| | |
|---|---|
| ***F41A 3/66*** | (2006.01) |
| ***F41G 11/00*** | (2006.01) |
| ***F41A 3/26*** | (2006.01) |
| ***F41A 3/72*** | (2006.01) |
| ***F41C 23/16*** | (2006.01) |

(52) U.S. Cl.

CPC ... *F41A 3/66* (2013.01); *F41A 3/26* (2013.01); *F41A 3/72* (2013.01); *F41C 23/16* (2013.01); *F41G 11/003* (2013.01)

(58) Field of Classification Search

CPC ..... F41A 3/72; F41A 3/66; F41A 7/02
USPC ..... 42/16, 6; 89/1.4, 191.01
See application file for complete search history.

(56) References Cited

U.S. PATENT DOCUMENTS

| | | | | |
|---|---|---|---|---|
| 2,771,819 | A * | 11/1956 | Morse | F41A 5/24 42/16 |
| 7,827,722 | B1 * | 11/2010 | Davies | F41A 3/94 42/71.01 |
| 7,849,777 | B1 * | 12/2010 | Zedrosser | F41A 3/26 42/16 |
| 8,266,998 | B1 * | 9/2012 | Davis | F41A 3/72 42/71.01 |
| 8,899,138 | B2 * | 12/2014 | Brown | F41A 3/72 89/1.4 |
| 8,997,620 | B2 * | 4/2015 | Brown | F41A 5/24 89/1.4 |
| 2003/0066226 | A1 * | 4/2003 | Martin | F41A 3/72 42/16 |
| 2010/0300278 | A1 * | 12/2010 | Zedrosser | F41A 3/26 89/180 |
| 2011/0083551 | A1 * | 4/2011 | Sirochman | F41A 3/72 89/191.01 |
| 2013/0174457 | A1 * | 7/2013 | Gangl | F41A 3/72 42/16 |

* cited by examiner

*Primary Examiner* — Samir Abdosh
*Assistant Examiner* — John D Cooper
(74) *Attorney, Agent, or Firm* — Schmeiser, Olsen & Watts LLP

(57) ABSTRACT

An upper receiver assembly for an AR style rifle is provided. The upper receiver assembly includes an upper receiver body with a channel formed in a side of the body. Further, the assembly includes a bolt carrier operatively coupled within the upper receiver body. A bolt is coupled within the bolt carrier, wherein a cam pin is coupled to the bolt and extends through an aperture of the bolt carrier. The assembly also includes a side charger having a charging handle that extends through the channel of the upper receiver body. The side charger also includes a bolt carrier engagement member. The bolt carrier engagement member engages the bolt carrier and moves the cam pin in response to pulling the charging handle toward the butt stock of the weapon. This results in charging the rifle.

17 Claims, 16 Drawing Sheets

UPPER RECEIVER ASSEMBLY FOR A WEAPON

CROSS REFERENCE TO RELATED APPLICATION[S]

This application claims priority to U.S. Provisional Patent Application entitled "UPPER RECEIVER ASSEMBLY FOR A WEAPON," Ser. No. 61/814,220, filed Apr. 20, 2013, now pending, the disclosure of which is hereby incorporated entirely herein by reference.

BACKGROUND OF THE INVENTION

1. Technical Field

This invention relates generally to an upper receiver assembly for a weapon and more particularly to an upper receiver assembly with a side charging handle for an AR style rifle or similar weapon.

2. State of the Art

Currently, weapons are used for a variety of reasons from recreational use, to hunting and for tactical use by law enforcement and the like. In particular, rifles are a commonly owned weapon and used for various reasons. A rifle, such as an AR-15 or an AR-10, has the capability for use with multiple calibers of ammunition. In order to charge the weapon, conventional charging assemblies are located on the top of the weapon toward the rear of the upper receiver. This location requires movement from a typical shooting orientation of the weapon in order to charge it.

Accordingly, there is a need for an upper receiver that allows for a different location for a charging assembly.

SUMMARY OF THE INVENTION

The present invention relates to an upper receiver with a side charging handle for an AR style rifle or similar weapon.

In embodiments, an upper receiver assembly for an AR style rifle comprises an upper receiver body with a channel formed in a side of the body; a bolt carrier operatively coupled within the upper receiver body; a bolt coupled within the bolt carrier, wherein a cam pin is coupled to the bolt and extends through an aperture of the bolt carrier; and a side charger having a charging handle that extends through the channel of the upper receiver body and a bolt carrier engagement member, wherein the bolt carrier engagement member engages the bolt carrier and moves the bolt carrier in response to pulling the charging handle toward the butt stock of the weapon.

In some embodiments, the upper receiver assembly comprises a hinged member moveable between an open and a closed position. The hinged member is moveable to the open position when the upper receiver is disengaged from a lower receiver. Additionally, the hinged member is retained in the closed position when the upper receiver is engaged with a lower receiver.

In some embodiments, the upper receiver assembly comprises a raised section in the cam pin, wherein the raised section provides better engagement with the camp pin engagement member.

In some embodiments, the upper receiver assembly comprises a gas port aperture, wherein the gas port aperture and a gas port set screw, wherein a gas tube of the rifle extends into the upper receiver assembly through the set screw to engage a gas key of the bolt carrier.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to an upper receiver with a side charging handle for an AR style rifle or similar weapon.

Figure 1:
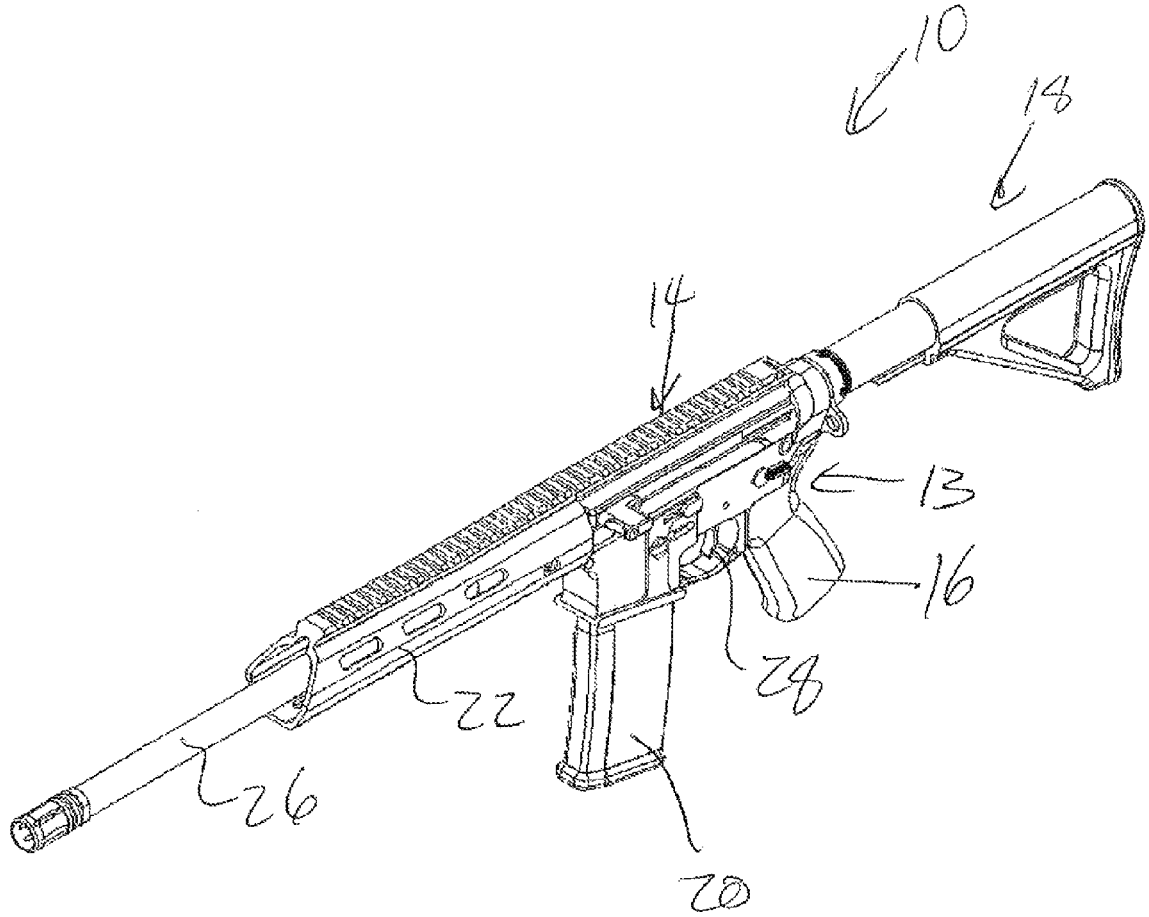
FIG. 1 is a perspective view of a rifle with an upper receiver operatively coupled thereto.
Figure 2:
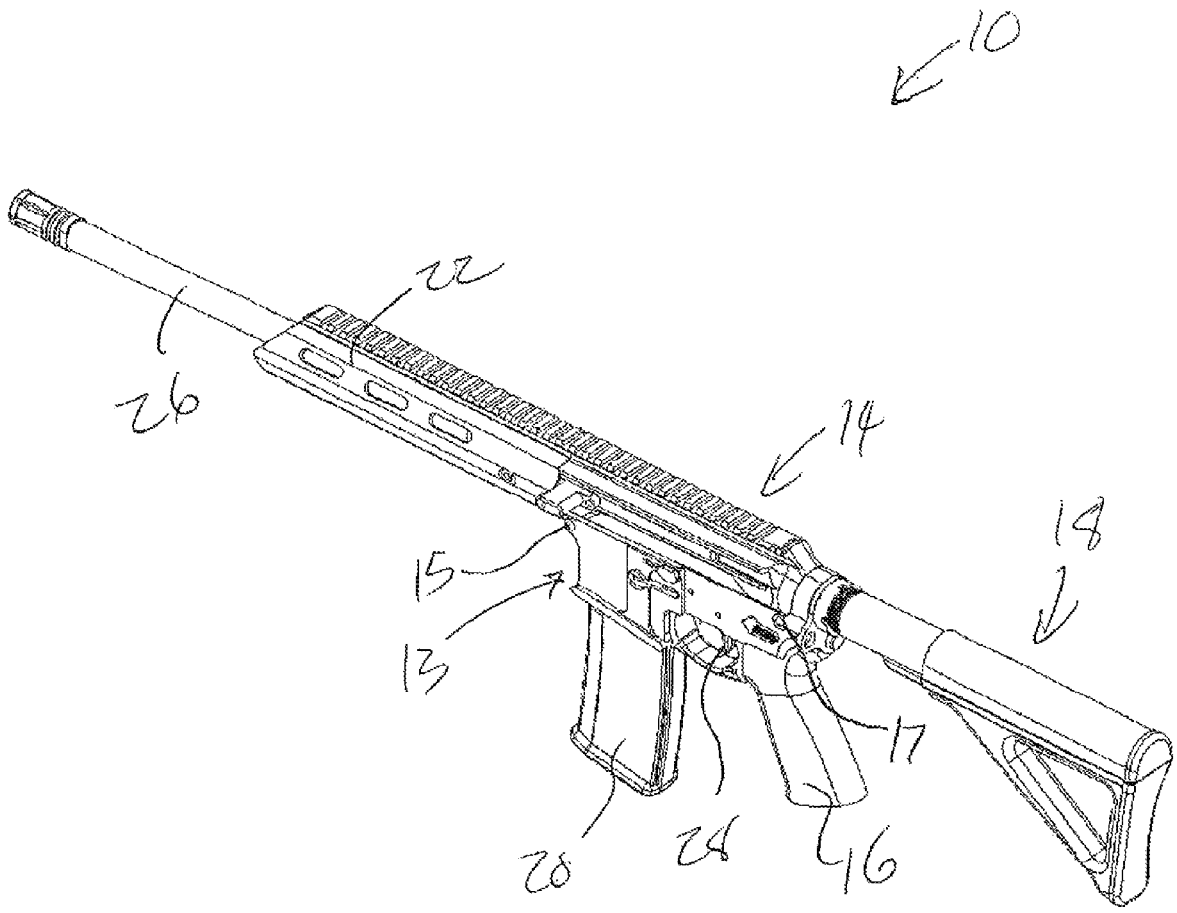
FIG. 2 is another perspective view of a rifle with an upper receiver operatively coupled thereto.
Figure 3:
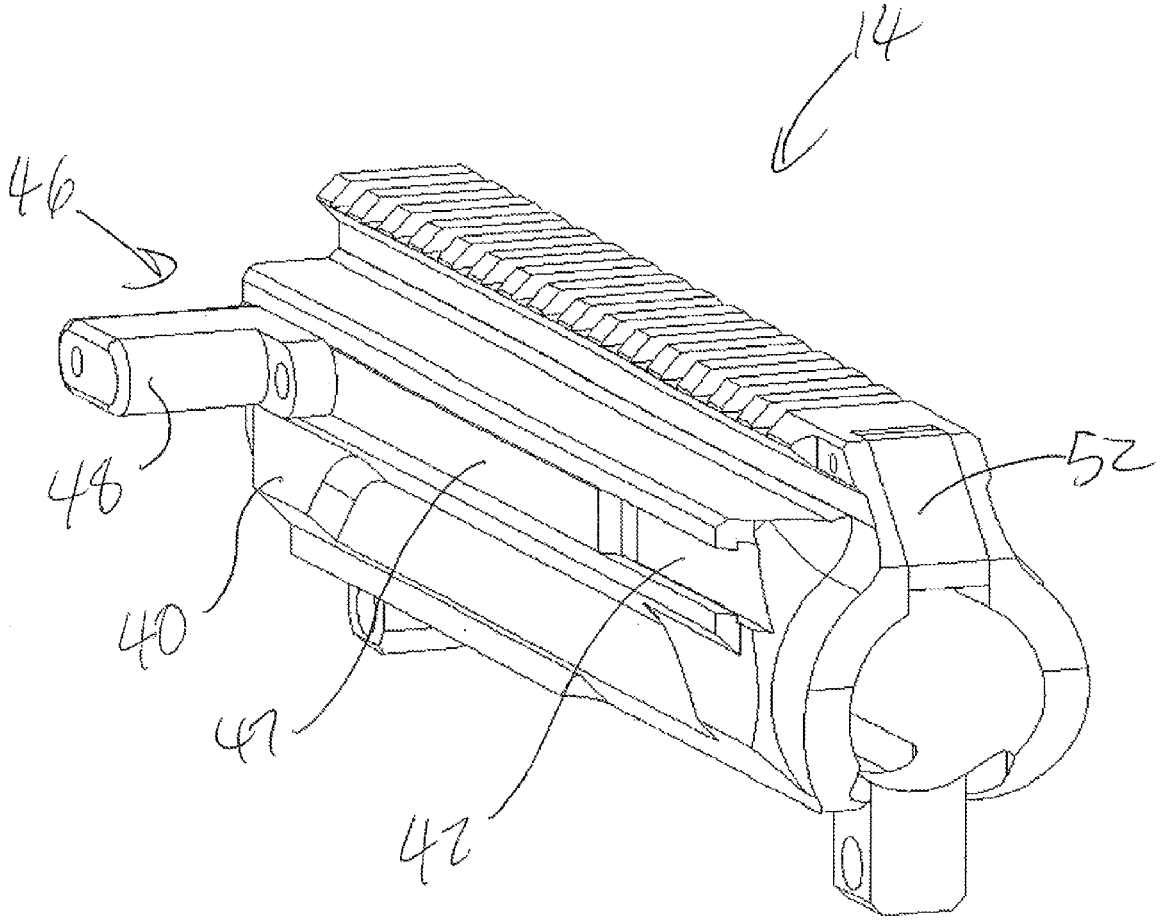
FIG. 3 is a perspective view of an upper receiver assembly.
Figure 4:
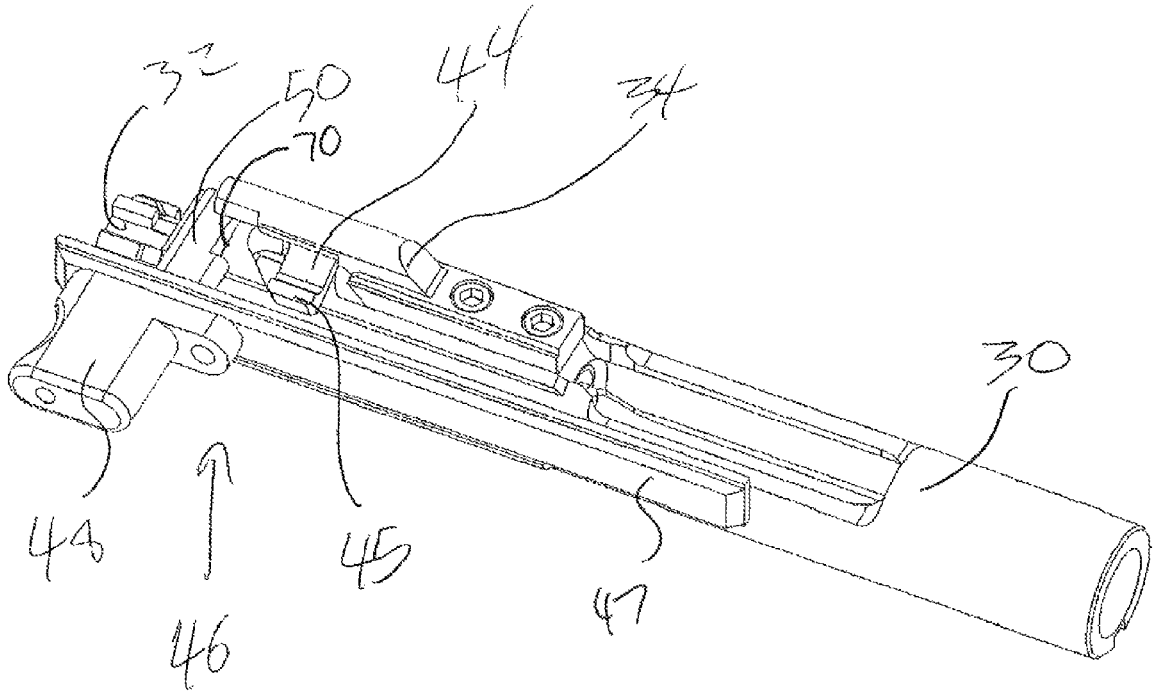
FIG. 4 is a perspective view of a bolt with bolt carrier and a side charger.
Figure 5:
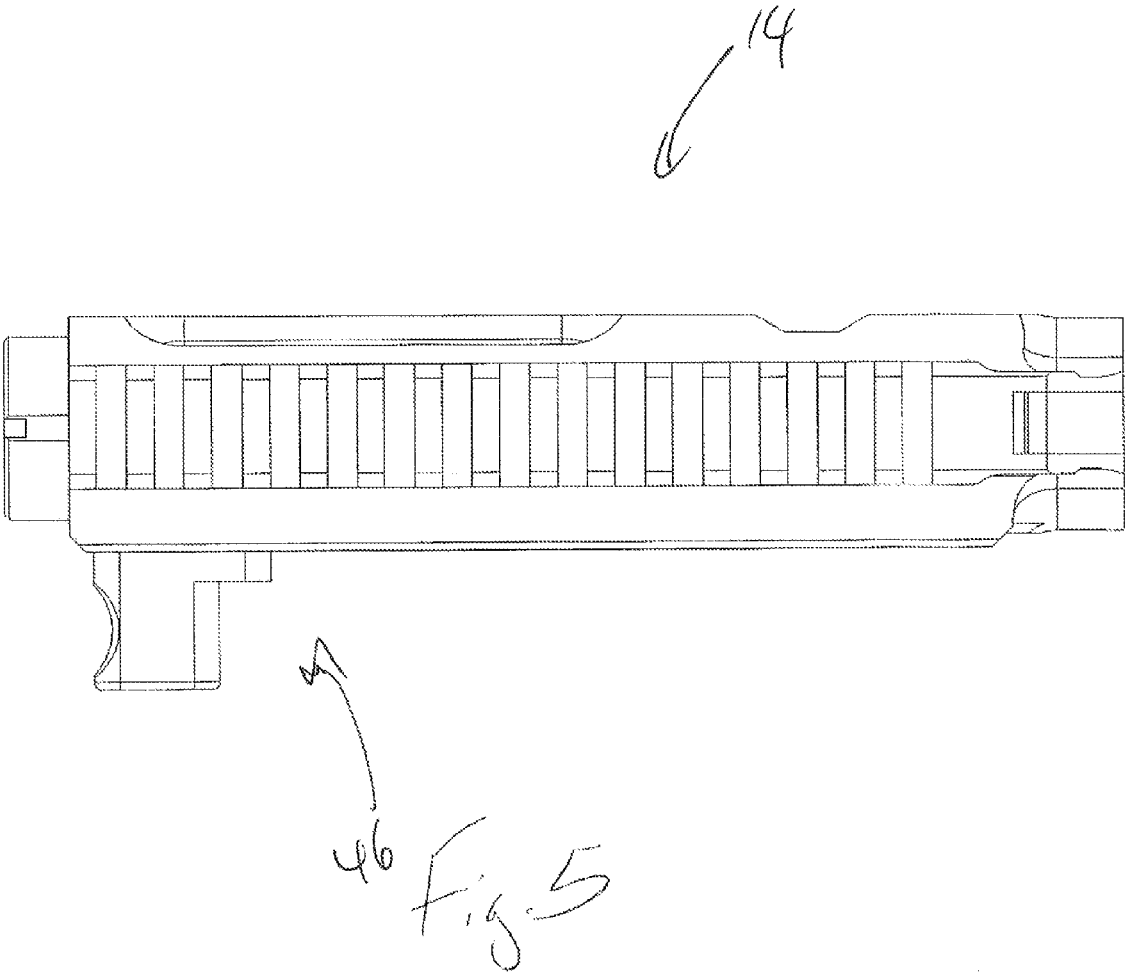
FIG. 5 is a top view of an upper receiver assembly.
Figure 6:
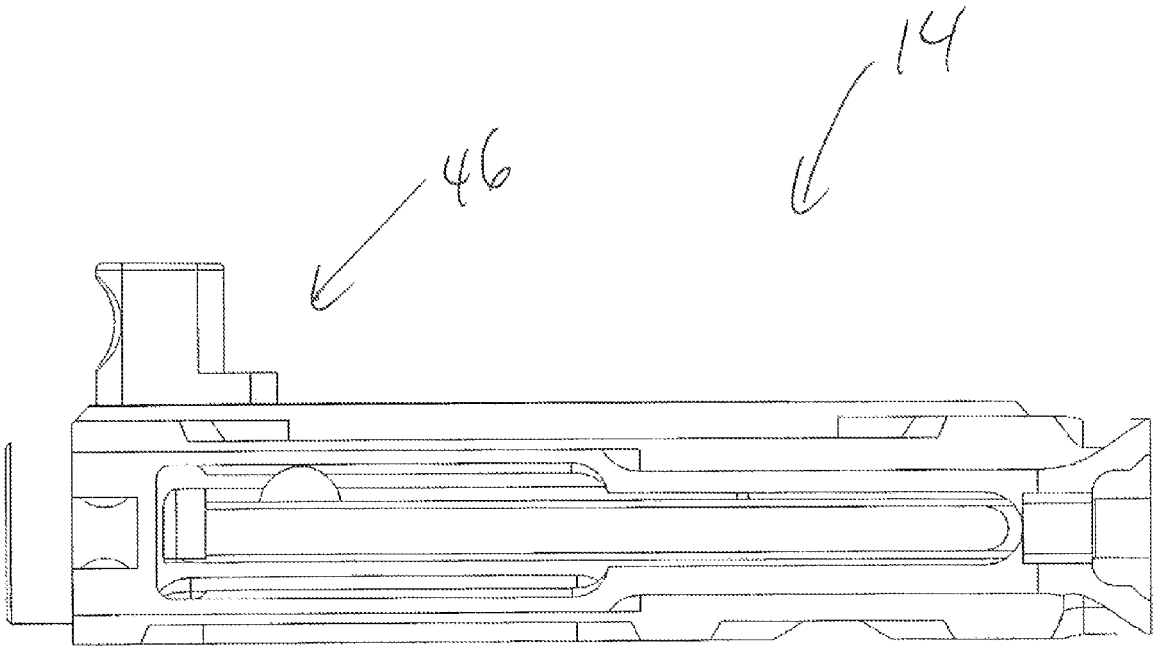
FIG. 6 is a bottom view of an upper receiver assembly.
Figure 7:
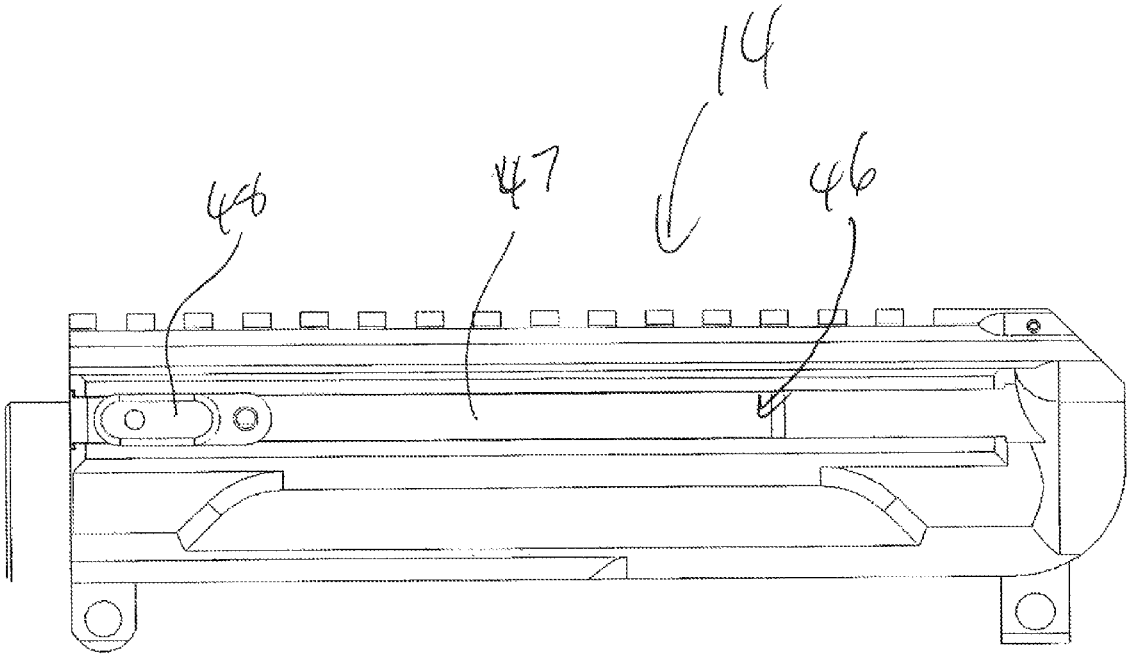
FIG. 7 is a left side view of an upper receiver assembly.
Figure 8:
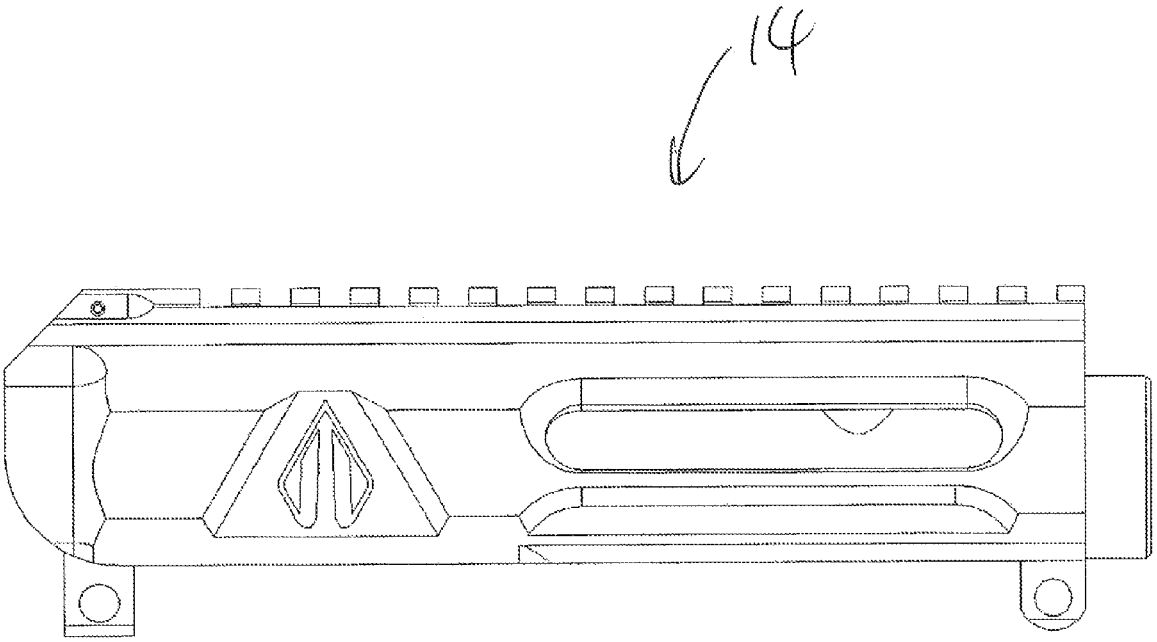
FIG. 8 is a right side view of an upper receiver assembly.
Figure 9:
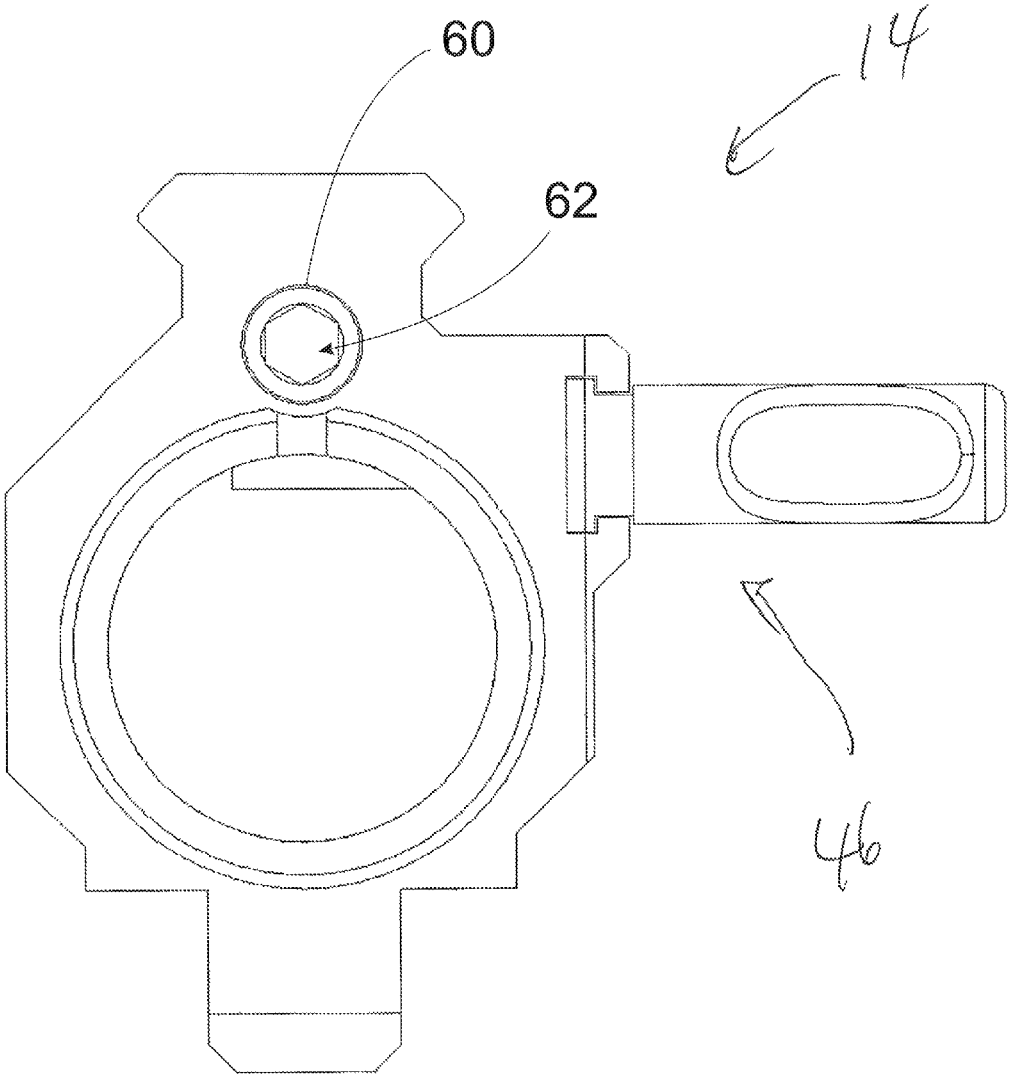
FIG. 9 is a front view of an upper receiver assembly.
Figure 10:
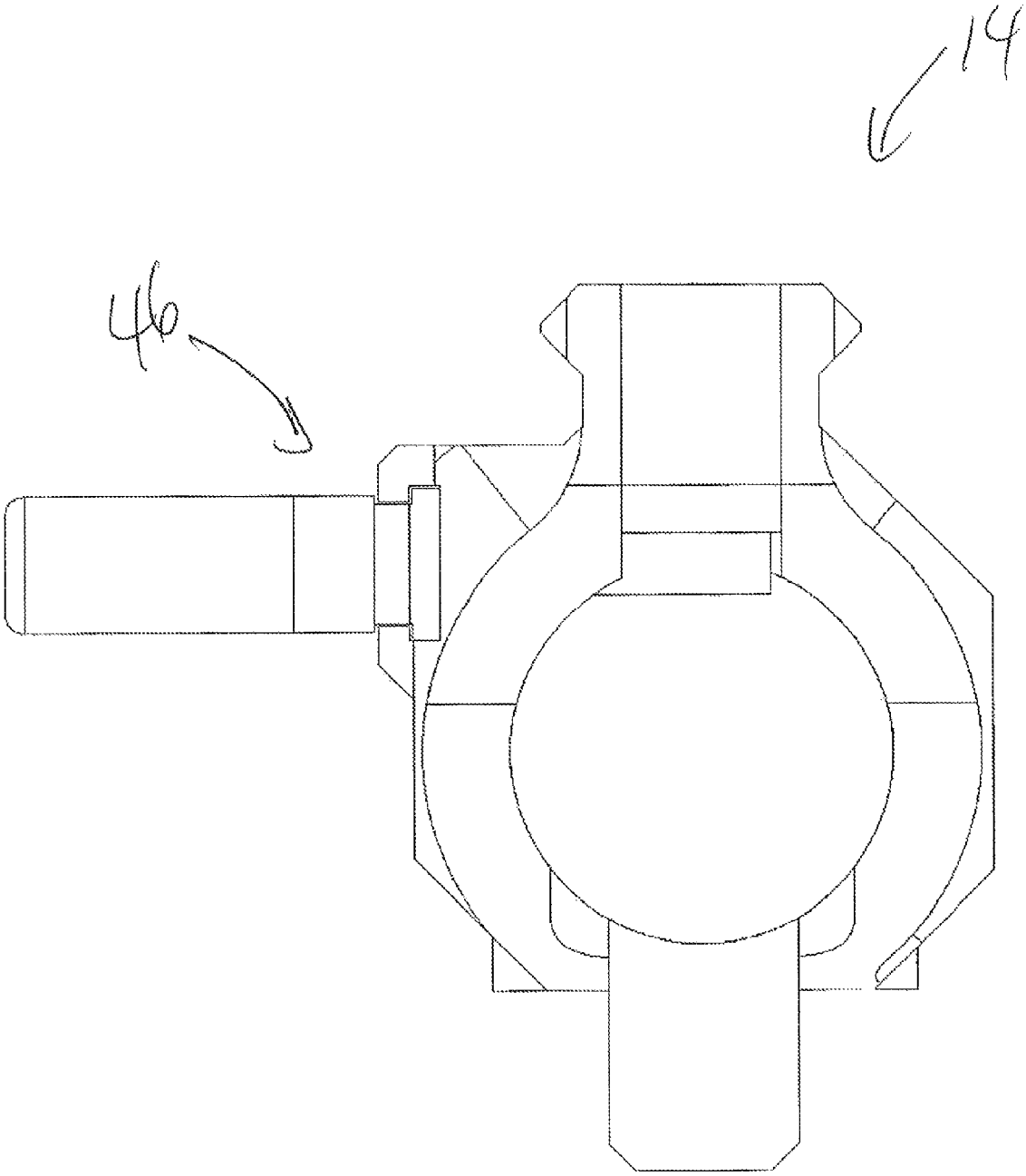
FIG. 10 rear view of an upper receiver assembly.
Figure 11:
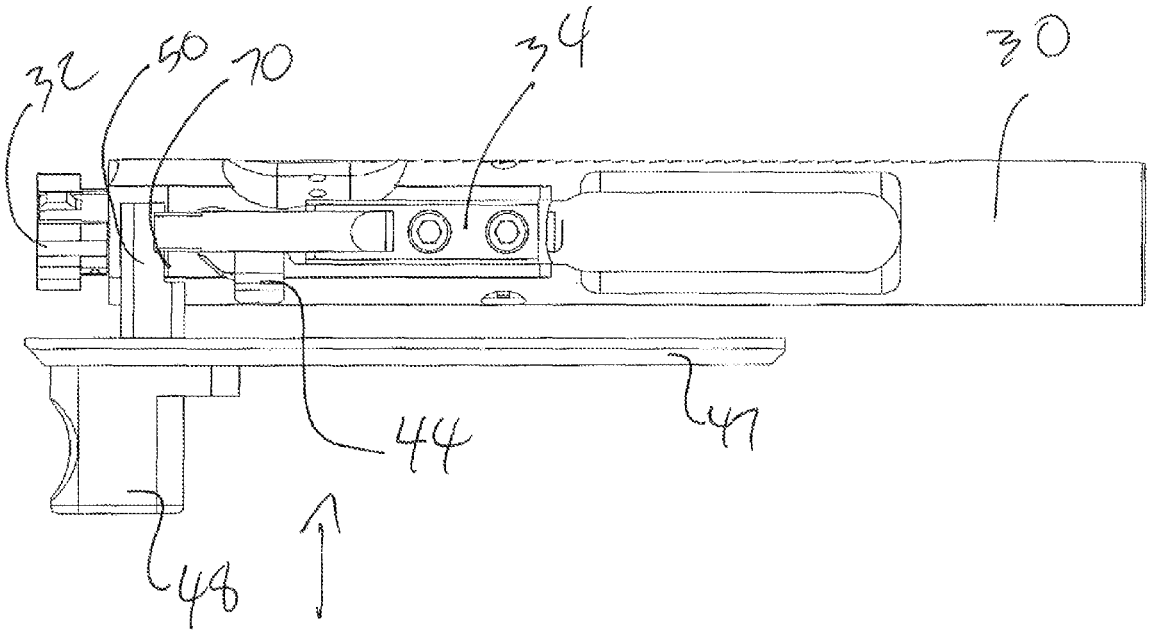
FIG. 11 is a top view of a bolt with bolt carrier and a side charger.
Figure 12:
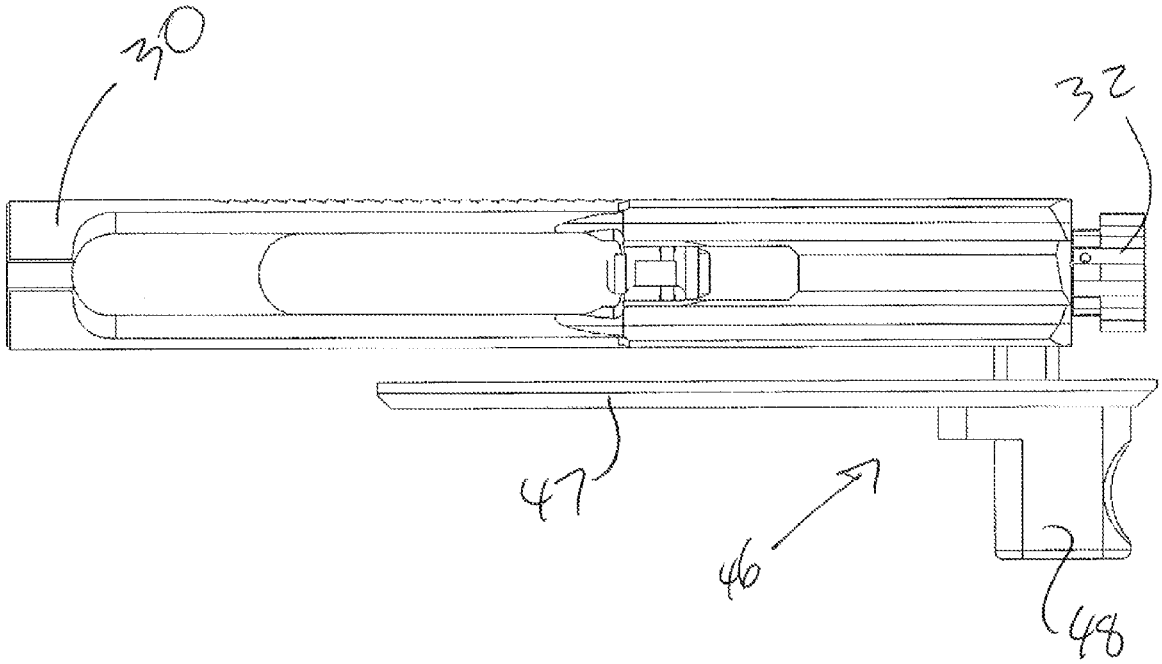
FIG. 12 is a bottom view of a bolt with bolt carrier and a side charger.
Figure 13:
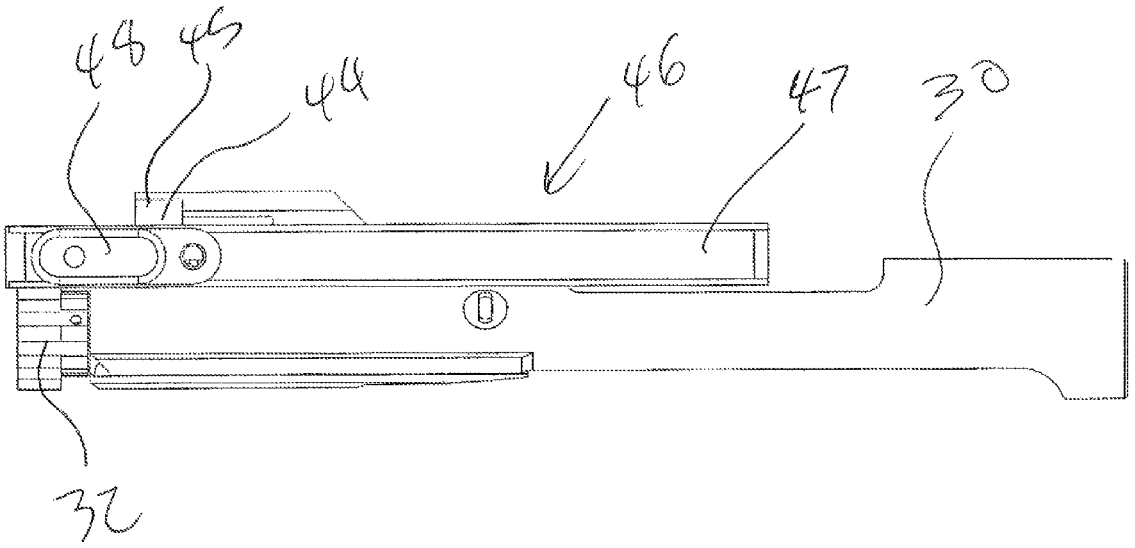
FIG. 13 is a left side view of a bolt with bolt carrier and a side charger.
Figure 14:
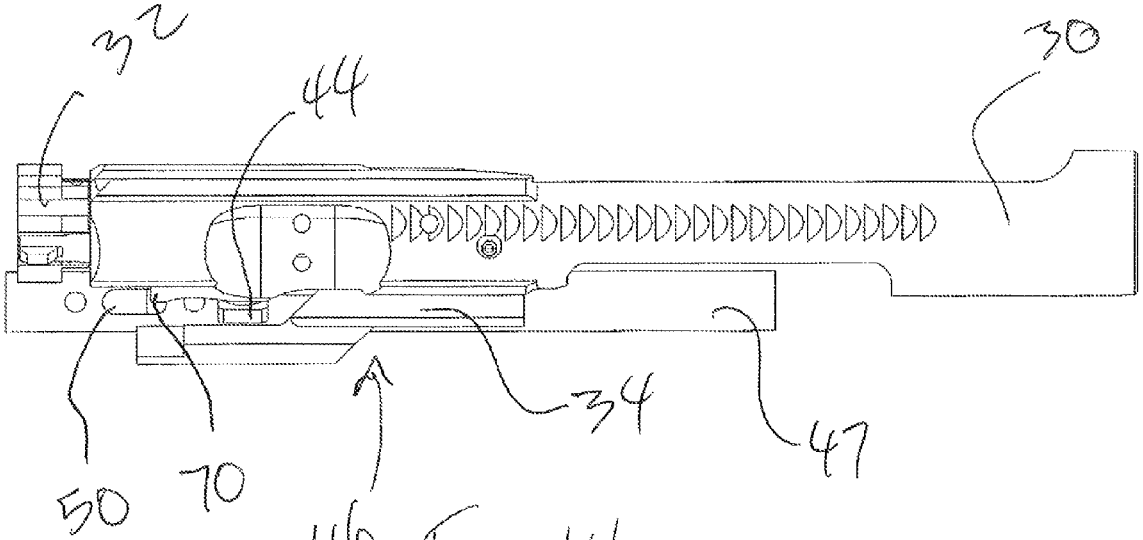
FIG. 14 is a right side view of a bolt with bolt carrier and a side charger.
Figure 15:
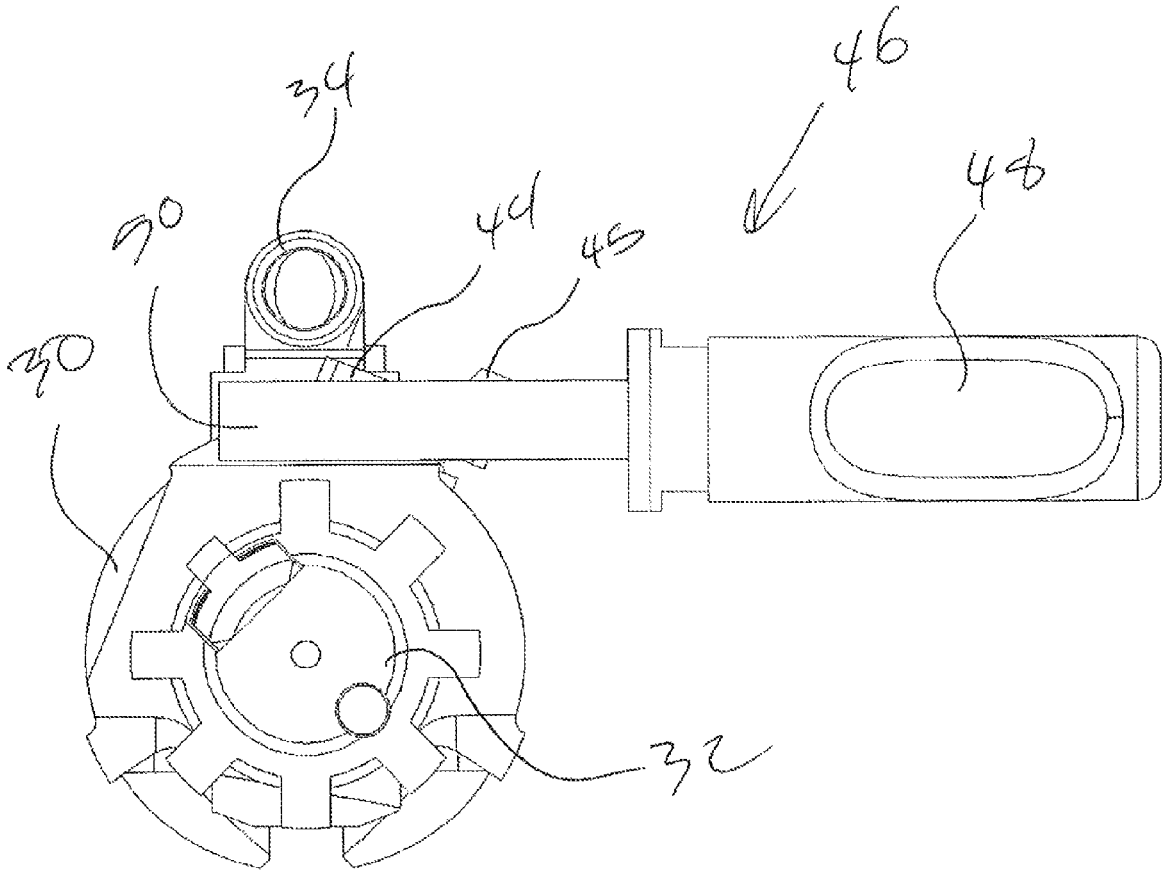
FIG. 15 is a front view of a bolt with bolt carrier and a side charger.
Figure 16:
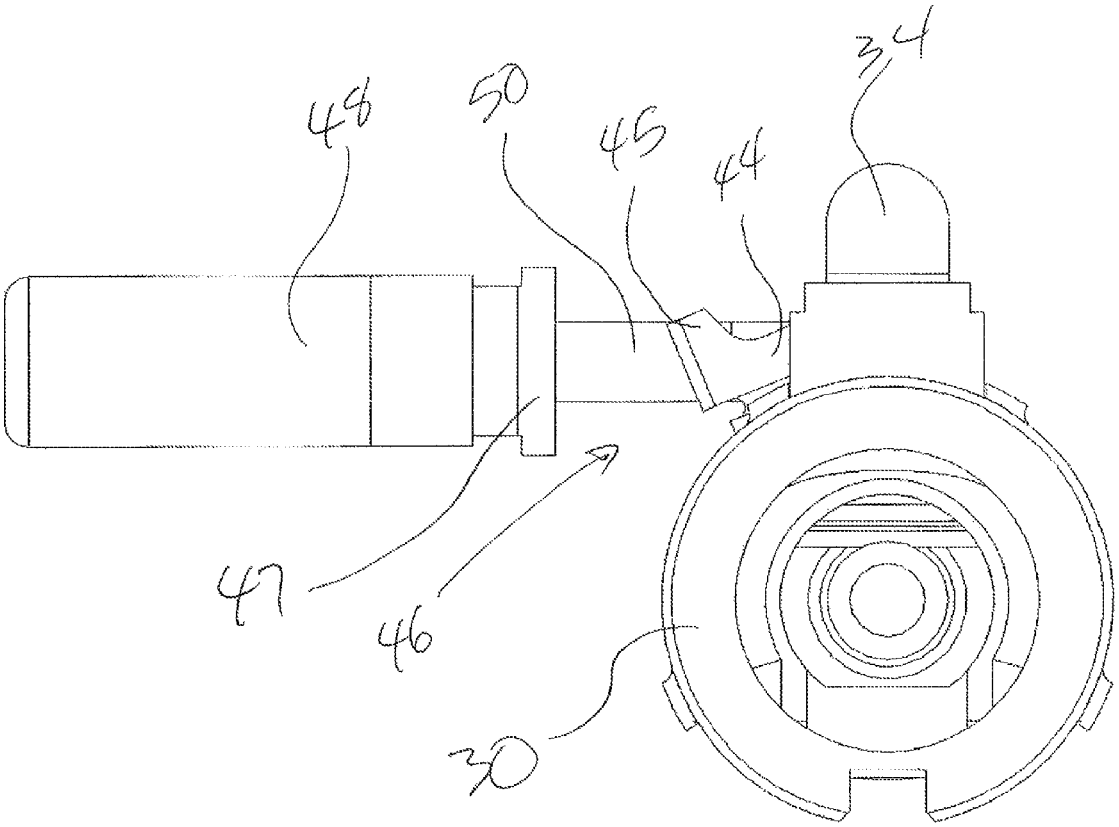
FIG. 16 is a rear view of a bolt with bolt carrier and a side charger.

Referring to the drawings, FIGS. 1 and 2 depict a rifle 10 with the conversion kit 12 coupled there to. The rifle 10 comprises a lower receiver 13, wherein the lower receiver is coupled to a pistol grip 16, a butt stock 18, a trigger 28 a magazine 20 and all other components that are conventionally part of an AR style rifle. The rifle 10 further comprises an upper receiver 14, wherein the upper receiver is coupled to a barrel 26, and a hand guard 22. A bolt carrier and bolt are operationally coupled within the upper receiver 14. According to embodiments of the present invention, the lower receiver 13 is operatively coupled with the upper receiver 14 by use of two pins, wherein the two pins comprise a front pin 15 and a rear pin 17. The coupling of the lower receiver 13 to the upper receiver 14 results in a mechanical coupling of all of the interior operational components located within the lower receiver and the bolt carrier 30 of the upper receiver 14. All of the components are operationally assembled together.

It will be understood that the lower receiver 13, the butt stock 18, the trigger 28, the hand guard 22, pistol grip 16, and the barrel 26 and all other external and internal components not specifically discussed are assembled in an AR style rifle, and are part of the rifle 10. The upper receiver assembly 14 of the rifle 10 includes other conventional parts that are not specifically discussed in this disclosure and therefor in at least this way, the upper receiver assembly 14 may fully replace a conventional upper receiver assembly of an AR style.

With additional reference to FIGS. 3-16, the upper receiver assembly 14 includes an upper receiver body 40 with a channel 42 formed in a side of the body 40. A bolt carrier 30 with a bolt 32 is operatively coupled within the upper receiver body 40. The upper receiver assembly 14 comprises a cam pin 44, wherein the cam pin 44 engages the bolt 32 and extends through an aperture of the bolt carrier 30. The upper receiver assembly 14 also comprises a side charger 46 having a charging handle 48 that extends through the channel 42 of the upper receiver body 40. The side charger 46 also includes a bolt carrier engagement member 50, wherein the bolt carrier engagement member 50 engages protrusion 70 located in front of the cam pin 44 and moves the bolt carrier 30 in response to pulling the charging handle 48 toward the butt stock 18 of the rifle 10. The side charger 46 comprises a sliding connector 47, wherein the charging handle 48 and the bolt carrier engagement member 50 are coupled to the sliding connector 47. The sliding connector 47 engages the channel 42 of the upper receiver body 40 and allows for the side charger 46 to slide toward the butt stock 18 of the rifle 10 by applying force to the charging handle 48 in a direction toward the butt stock 18.

The upper receiver assembly 14 may also comprise a hinged member 52 moveable between an open and a closed position. The hinged member 52 is moveable to the open position when the upper receiver 14 is disengaged from a lower receiver 13. Further, the hinged member 14 is retained in the closed position when the upper receiver 14 is engaged with a lower receiver 13.

The upper receiver assembly 14 also comprises a raised section 45 in the cam pin 44, wherein the raised section 45 allows for the cam pin 44 to operate correctly within the upper receiver body 40. The upper receiver body 40 has been modified from conventional upper receiver bodies to account for the side charger 46.

The upper receiver assembly 14 comprises a gas port aperture 60. The gas port aperture 60 operates to allow a gas port to extend into the upper receiver assembly 14. In embodiments, the gas port aperture 60 includes a gas port set screw 62 mounted within the gas port aperture 60. A gas tube of the rifle 10 extends into the upper receiver assembly 14 through the set screw 62 to engage a gas key 34 of the bolt carrier 30.

Accordingly, the components defining any upper receiver assembly may be formed of any of many different types of materials or combinations thereof that can readily be formed into shaped objects provided that the components selected are consistent with the intended operation of a upper receiver assembly. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any upper receiver assembly may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. An upper receiver assembly for an AR rifle, the upper receiver comprising:

an upper receiver body with a channel formed in a side of the body;

a bolt carrier operatively coupled within the upper receiver body, wherein the bolt carrier comprises a protrusion on a top side of the bolt carrier;

a bolt coupled within the bolt carrier, wherein the bolt extends from a front end of the bolt carrier; and a side charger having a charging handle that extends through the channel of the upper receiver body and a bolt carrier engagement member, wherein the bolt carrier engagement member engages the protrusion of the bolt carrier and wherein the bolt carrier engagement member moves the bolt carrier in response to pulling the charging handle toward the butt stock of the rifle.

2. The upper receiver assembly of claim 1, further comprising a hinged member moveable between an open and a closed position.

3. The upper receiver assembly of claim 2, wherein the hinged member is moveable to the open position when the upper receiver is disengaged from a lower receiver.

4. The upper receiver assembly of claim 2, wherein the hinged member is retained in the closed position when the upper receiver is engaged with a lower receiver.

5. The upper receiver assembly of claim 1, further comprising a cam pin with a raised section in the cam pin, wherein the raised section provides proper operation of the cam pin within the upper receiver body.

6. The upper receiver assembly of claim 1, further comprising a gas port aperture, wherein the gas port aperture and a gas port set screw, wherein a gas tube of the rifle extends into the upper receiver assembly through the set screw to engage a gas key of the bolt carrier.

7. The upper receiver assembly of claim 1, wherein the bolt carrier further comprises a protrusion located in front of the cam pin, wherein the bolt carrier engagement member engages the protrusion of the bolt carrier.

8. The upper receiver assembly of claim 1, further comprising a sliding connector, wherein the charging handle and the bolt carrier engagement member are coupled to the sliding connector.

9. The upper receiver assembly of claim 8, wherein the sliding connector is slideably coupled to the channel of the upper receiver body to allow the side charger to slide with respect to the upper receiver body.

10. An AR rifle comprising:

a lower receiver;

a butt stock coupled to the lower receiver;

a trigger operatively coupled within the lower receiver;

a magazine removeably coupled to the lower receiver for holding ammunition; and an upper receiver assembly coupled to the lower receiver and a barrel, wherein the upper receiver assembly comprises:

an upper receiver body with a channel formed in a side of the body;

a bolt carrier operatively coupled within the upper receiver body, wherein the bolt carrier comprises a protrusion on a top side of the bolt carrier;

a bolt coupled within the bolt carrier, wherein the bolt extends from a front end of the bolt carrier and a cam pin extends from a top side of the bolt carrier adjacent the protrusion; and a side charger having a charging handle that extends through the channel of the upper receiver body and a bolt carrier engagement member, wherein the bolt carrier engagement member engages the protrusion of the bolt carrier in front of the cam pin and moves the bolt carrier in response to pulling the charging handle toward the butt stock of the rifle.

11. The rifle of claim 10, wherein the upper receiver assembly further comprising a hinged member moveable between an open and a closed position.

12. The rifle of claim 11, wherein the hinged member is moveable to the open position when the upper receiver is disengaged from a lower receiver.

13. The rifle of claim 11, wherein the hinged member is retained in the closed position when the upper receiver is engaged with a lower receiver.

14. The rifle of claim 10, wherein the upper receiver assembly further comprises a cam pin with a raised section in the cam pin, wherein the raised section provides proper operation of the cam pin within the upper receiver body.

15. The rifle of claim 10, further comprising a gas port aperture, wherein the gas port aperture and a gas port set screw, wherein a gas tube of the rifle extends into the upper receiver assembly through the set screw to engage a gas key of the bolt carrier.

16. The rifle of claim 10, further comprising a sliding connector, wherein the charging handle and the bolt carrier engagement member are coupled to the sliding connector.

17. The rifle of claim 16, wherein the sliding connector is slideably coupled to the channel of the upper receiver body to allow the side charger to slide with respect to the upper receiver body.

* * * * *